United States Patent [19]

Kimball

[11] 3,938,873

[45] Feb. 17, 1976

[54] ELECTRICAL PLUG MOUNTING DEVICE FOR POWER TOOLS

[76] Inventor: James F. Kimball, Star Rte. 2, Box 466, Dexter, Oreg. 97431

[22] Filed: Oct. 3, 1974

[21] Appl. No.: 511,634

[52] U.S. Cl. ..... 339/58; 339/126 R

[51] Int. Cl.[2] ..... H01R 11/02

[58] Field of Search ..... 339/58, 126 R, 126 RS, 339/126 J, 129, 132 R, 132 B, 132 T, 133 R, 133 T, 134

[56] References Cited

UNITED STATES PATENTS

| | | | |
|---|---|---|---|
| 2,869,094 | 1/1959 | Francis | 339/126 RS X |
| 2,947,966 | 8/1960 | Francis et al. | 339/58 X |
| 3,002,175 | 9/1961 | Bertram et al. | 339/126 R |
| 3,387,253 | 6/1968 | Salners et al. | 339/126 RS |
| 3,843,224 | 10/1974 | Gerke et al. | 339/58 |

FOREIGN PATENTS OR APPLICATIONS

| | | | |
|---|---|---|---|
| 1,034,741 | 7/1966 | United Kingdom | 339/126 R |
| 1,665,408 | 3/1971 | Germany | 339/126 RS |

*Primary Examiner*—Joseph H. McGlynn
*Assistant Examiner*—Howard N. Goldberg
*Attorney, Agent, or Firm*—James D. Givnan, Jr.

[57] ABSTRACT

A device for incorporation into the housing of a hand held power tool to locate an electrical plug body firmly in place on the housing exterior. A base of the device is firmly held within the housing by being of a corresponding shape with filler means contributing towards base securement. A neck portion extends through the power cord opening in the housing. The plug body is exterior of the housing and may be of the standard type or provided with twist-lock terminals.

3 Claims, 8 Drawing Figures

1
2
3
3A
4
10
11
12
13
14
15
16
17
18
19
20
21
5
4'
10'
11'
12'
13'
15'
16'
5'

ELECTRICAL PLUG MOUNTING DEVICE FOR POWER TOOLS

BACKGROUND OF THE INVENTION

The present invention is directed toward a device for the novel mounting of an electrical plug member rigidly on a power tool housing.

Hand held power tools commonly include a length of permanently attached electrical cord several feet in length with a plug member thereon for insertion into a wall or extension cord outlet or socket. Often many power tools are stored or carried together by workmen within a tool box resulting in their attached lengths of cord becoming entangled with one another and with other tools which necessitates time consuming disentanglement prior to starting each job. A second disadvantage to tools having permanently attached lengths of cord is that hurried untangling of same oftimes results in damage to other tools within the tool box and to their cords. Further, the length of electrical cord provided integrally with each tool contributes to tool cost which could be avoided by use of a single cord of convenient length for all power tools.

Summary of the Invention

The present invention is directed toward the installation of a plug member on a power tool housing such as for example on the handle of a power drill to enable convenient attachment and separation of a suitable length of power cord.

For installation within a tool housing, the present device includes a base of dielectric material which is configured for reception within the housing. Said base, in conjunction with filler means, serves to mount an electrical plug member exteriorly adjacent the tool housing wall in a secure manner. Accordingly, both axial and twisting loads as may be imparted during socket coupling or uncoupling as well as loads encountered during tool use are withstood without dislocation of the device. An exterior portion of the device embodies substantially conventional plug components which may be those of either standard three-prong configuration or twist-lock prongs commonly found on cords used in conjunction with heavy-duty power tools. A modified form of the invention utilizes shims providing secure attachment of the device to the tool housing.

Important objects of the invention include the provision of: a plug member adapted for convenient incorporation into an existing tool housing to provide an electrical plug closely adjacent the tool housing for reception of a service cord of any length; a plug member having a base interiorly disposed within a tool housing in a manner resisting both axial and twisting loads imparted to the plug member during coupling and uncoupling of the cooperating plug member; a plug member readily adaptable to existing power tools without modification of the tool; a device attaining the aforementioned objectives while providing insulative protection to current carrying wires; a device having a base internally housed within the tool and rigidly supporting plug components of either the standard or twist-lock type for use with a power cord of a desired length which may be detached and stored separately in an orderly manner at the completion of a job.

DETAILED DESCRIPTION OF THE PREFERRED EMBODIMENTS

Figures 1, 2, 3, 4, 5, 6, 7, 8:
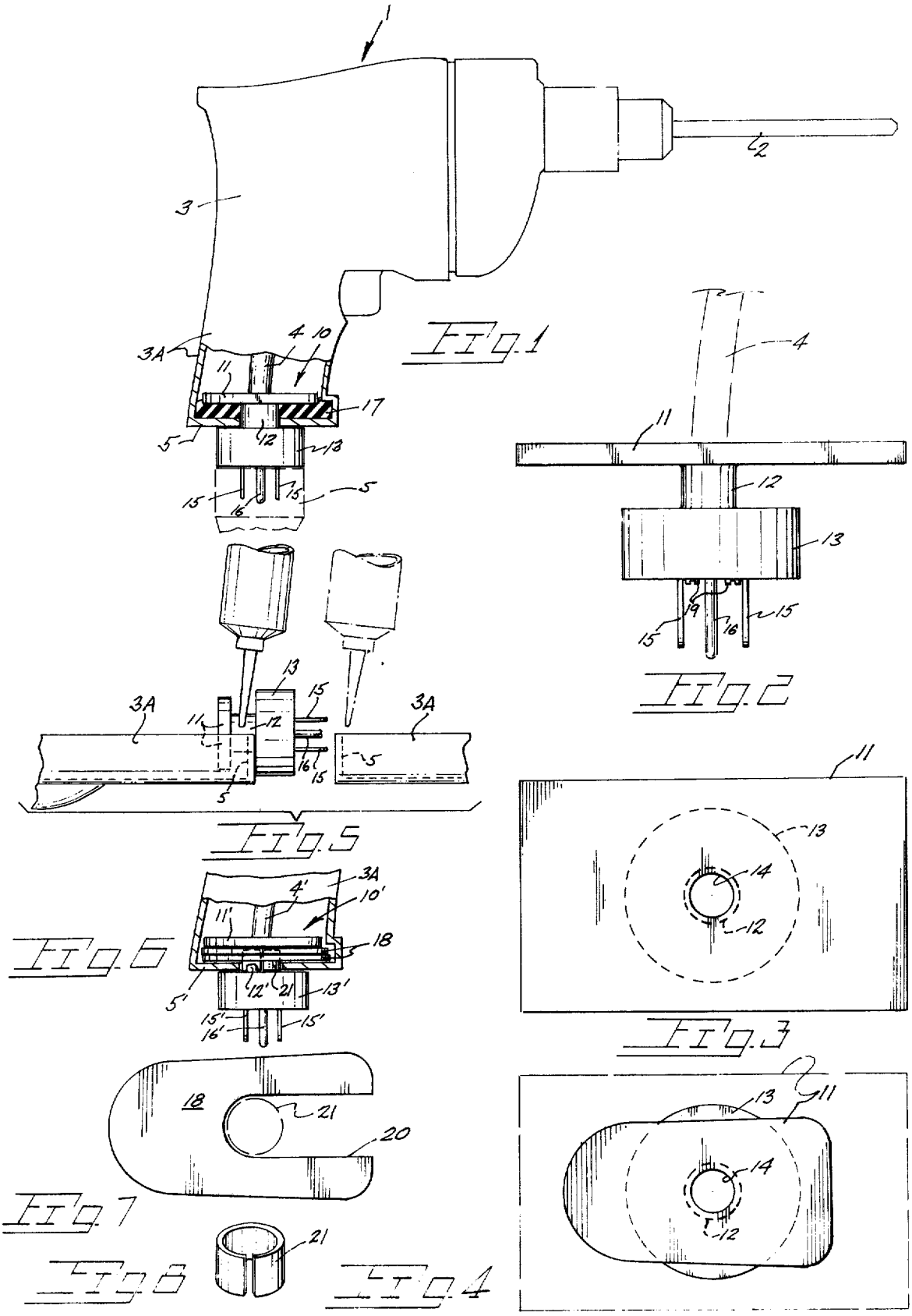
FIG. 1 is a side elevational view of a hand held power tool with a portion of the tool housing broken away to disclose the present invention.
FIG. 2 is a side elevational view of the device removed from the tool housing.
FIG. 3 is a plan view of FIG. 2.
FIG. 4 is a view similar to FIG. 3 with the base configured for incorporation within the tool housing of FIG. 1.
FIG. 5 is an elevational view of separated tool housing halves with the present device being shown partially installed therewithin.
FIG. 6 is a view similar to FIG. 1 showing a portion of a tool housing broken away and within which a modified form of the invention is installed.
FIG. 7 is an enlarged plan view of a shim used in the modified form of the invention.
FIG. 8 is a perspective view of a collar for use in conjunction with the modified form of the invention.

With continuing reference to the accompanying drawings wherein applied reference numerals indicate parts similarly identified in the following specification, the reference numeral 1 indicates generally a conventional power drill of the hand held type used primarily for powering drill bits 2. Such power drills normally include a light weight housing 3 of cast metal or a combination of cast metal and durable plastic enclosing the drill motor and switch components.

Conventionally, electrical current is provided to the drill motor via a power cord 4 which extends through a tool housing handle portion 3A the cord normally being several feet in length beyond a handle bottom wall 5 and fitted with a plug for insertion into a wall outlet or extension cord socket.

The present plug device is indicated generally at 10 having a base 11 for disposition internally within the tool housing which, as shown in FIG. 1, may be the handle portion 3A of a power drill housing. As the present invention is intended for incorporation into other hand held power tools it will be readily obvious that its use is not restricted to the particular combination shown but rather is intended for use with any tool having a separable housing within which may be installed base 11. Other tools for example may include various types of portable sanders and saws.

With reference to FIG. 2, base 11 is integral with a neck portion 12 which, in turn, is integral with a plug body 13. The base, neck and plug body are of molded, dielectric construction having an opening 14 extending therethrough for the reception of power cord segment 4 which may be that cord originally provided with the power tool. Power cord wire leads terminate in securement with binding posts 19 or other suitable connection to contact blades 15 and a ground prong 16. Details of the binding posts and lead attachment thereto are in accordance with conventional practice.

Base 11 is of a durable dielectric material such as nylon, of a planar shape, which lends itself to shaping, as by filing, to correspond to that area of the tool housing in which it is to be received. FIG. 4 discloses the base 11 typically configured for placement within the handle portion 3A of power drill 1 with other configurations of base 11 being suitable for other tool installations. An objective obtained by the reconfiguration of base 11 is the prevention of rotational movement of the base within the housing. In other instances where there is no housing structure immediately adjacent base 11, later described filler means is of a cementitious nature to effect secure attachment between the base and internal housing structure.

With reference to FIGS. 1 and 5, the separable housing 3 of the drill is opened for installation of the device within hand portion 3A. Typically, a bottom wall 5 of said handle portion defines an opening which normally receives power cord 4 and some sort of grommet device to prevent cord abrasion. Device 10 is placed into one-half of the drill housing handle as shown in FIG. 5 with filler means in the form of tube contained cementitious material 17 being injected intermediate the base and bottom wall 5 of the handle portion. A suitable material for this purpose is silicone cement which has an adhesive nature and sets up to a very firm consistency. The cement adheres to base 11 and bottom wall 5 thereby securing base 11 firmly within the handle portion. The remaining half of the disassembled handle portion 3A is likewise provided with a thickness of cementitious material 17 approximately the thickness equal to the space between the opposing surfaces of base 11 and bottom wall 5 with reassembly of the drill housing resulting in the lowermost surface of base 11 being supported fully by the cementitious material 17. The passage of any material upwardly past the outer edge of base 11 is not critical and in some instances further secures base 11 within its encompassing housing 3A. Setting up of the cementitious material 17 provides a firm support for base 11 to resist axial and rotational displacement of the device during both coupling and uncoupling of an extension cord socket S or loads imparted during use or accidental dropping of the tool.

FIG. 6 discloses a modified form of the invention wherein the device indicated generally at 10' includes a base 11', a neck 12', a plug body 13' with contact blades 15' and a ground prong 16'. The embodiment is as above described in the first form of the invention with the exception of the use of shims 18 in place of cementious material 17. The shims are bifurcated at 20 to enable same or a number of same to be slipped onto neck 12' immediately below base 11' prior to placement of the device into the disassembled handle portion of tool 1. Each shim 18 is desirably of dielectric material which may also be shaped along with base 11' if necessary for accommodation within a particular tool housing. The shims 18 serve to act as filler means between a handle wall 5' functioning in the manner of cementitious material 17 to secure the device in place. A collar 21 serves as an adapter in instances where neck 12' is of considerably less diameter than the opening in bottom wall 5' of the housing. Collar 21 may be used with either form of the invention to take up any disparity between the outer diameter of neck 12 or 12' and the cord opening typically provided in bottom wall 5, 5' of a power drill.

In a typical installation procedure, drill housing 3 is separated into its complementary halves as shown in FIG. 5 with the power cord 4 being severed a few inches below bottom wall 5. The severed cord end is threaded through opening 14 of the device whereupon the device is initially placed into a handle portion. The wire leads are stripped, cut and secured to binding posts 19 all in the well known manner. The contact blades 15 and prong 16 are intended to be typical of plug mounted contacts as it is to be understood the present device is equally adaptable to mounting twist-lock contacts as commonly used on heavy-duty power cords and power tools. Similarly, the attachment of leads of power cord 4 to plug contacts may be in any suitable manner.

While I have shown but a few embodiments of the invention it will be apparent to those skilled in the art that the invention may be embodied still otherwise without departing from the spirit and scope of the invention.

Having thus described the invention what is desired to be secured under a Letters Patent is:

1. A device for incorporation into the separable housing of a hand held power tool for mounting an electrical plug member component in exterior abutment with the housing, said device including, a base of non-metallic material disposed within the tool housing, said base of a shape substantially corresponding to an interior cross section of the housing, a plug body exterior of the tool housing and having contact blades projecting outwardly therefrom, a wall surface of said plug body for abutment with an exterior wall surface of the tool housing, a cylindrical neck portion extending intermediate said base and the plug body and of slightly greater length than the thickness of the tool housing wall, said neck portion of a diameter enabling reception within a cord receiving opening formed within said wall surface of the tool housing, and filler means disposed and fully occupying that area intermediate said base and the interior of said wall surface of the tool housing, said filler means contributing towards securement of the base in place within the tool housing thereby rigidly mounting the exteriorly located plug body against both axial and rotational loads.

2. The device claimed in claim 1 wherein said filler means is of a cementitious nature.

3. The device claimed in claim 1 additionally including a collar disposed about said neck portion and constituting an adapter.

* * * * *